US008608906B2

(12) United States Patent
Laleg et al.

(10) Patent No.: US 8,608,906 B2
(45) Date of Patent: Dec. 17, 2013

(54) CELLULOSE-REINFORCED HIGH MINERAL CONTENT PRODUCTS AND METHODS OF MAKING THE SAME

(75) Inventors: Makhlouf Laleg, Pointe-Claire (CA); Xujun Hua, Kirkland (CA)

(73) Assignee: FPInnovations, Pointe-Claire, Quebec (CA)

( * ) Notice: Subject to any disclaimer, the term of this patent is extended or adjusted under 35 U.S.C. 154(b) by 91 days.

(21) Appl. No.: 13/248,556

(22) Filed: Sep. 29, 2011

(65) Prior Publication Data

US 2012/0080156 A1 Apr. 5, 2012

Related U.S. Application Data

(60) Provisional application No. 61/388,939, filed on Oct. 1, 2010.

(51) Int. Cl.

| | |
|---|---|
| ***D21H 17/63*** | (2006.01) |
| ***D21H 21/10*** | (2006.01) |
| ***D21H 23/04*** | (2006.01) |
| ***D21H 23/24*** | (2006.01) |

(52) U.S. Cl.

USPC ..... 162/149; 162/141; 162/158; 162/164.1; 162/181.1; 106/401; 428/326; 428/357

(58) Field of Classification Search

USPC ..... 162/158, 164.1, 164.7, 168.1, 168.7, 162/181.1–181.8; 106/401, 461, 463–471; 428/118, 326, 357

See application file for complete search history.

(56) References Cited

U.S. PATENT DOCUMENTS

| | | | | |
|---|---|---|---|---|
| 4,609,431 | A | 9/1986 | Grose et al. | |
| 8,025,768 | B2 * | 9/2011 | Laleg et al. | 162/168.1 |
| 2004/0168782 | A1 * | 9/2004 | Silenius et al. | 162/181.1 |
| 2005/0133643 | A1 * | 6/2005 | Fernandez et al. | 241/16 |

FOREIGN PATENT DOCUMENTS

| | | |
|---|---|---|
| FI | 20095634 | 6/2009 |
| WO | 02/090652 | 11/2002 |
| WO | WO 2005061793 A1 * | 7/2005 |

OTHER PUBLICATIONS

Smook, Gary A., Handbook for Pulp and Paper Technologists, 2nd ed, Angus Wilde Publications, 1992, pp. 194-197 and 208.*

International Search Report, PCT/CA2011/001097,dated Nov. 30, 2011.

Baker, C. and Nazir, B., Practical ways forward to achieving higher filler content papers, Use of minerals in papermaking, Paper 5, Pira Conference, Manchester Feb. 26-27, 1997(11 pages).

* cited by examiner

*Primary Examiner* — Yogendra Gupta
*Assistant Examiner* — Dennis Cordray
(74) *Attorney, Agent, or Firm* — Norton Rose Fulbright Canada LLP

(57) ABSTRACT

A method to prepare aqueous furnishes useful as feedstock in the manufacture of very high-mineral content products, particularly paper sheets having mineral filler content up to 90% that display the required physical properties for the intended applications; the furnishes comprise fibrillated long fibers/mineral fillers mixed with anionic acrylic binders and co-additives, in presence or absence of cellulose fibrils; the fibrillated long fibers and cellulose fibrils provide high surface area for greater filler fixation and the reinforcement backbone network that ties all of the product components together; the anionic binders allow rapid and strong fixation of filler particles onto the surfaces of fibrils when mixing is conducted at temperatures higher than the glass transition temperature ($T_g$) of the binder. The aqueous furnish provides excellent filler retention and drainage during product fabrication.

20 Claims, 8 Drawing Sheets

Softwood kraft fibers (CSF 250 mL)

Softwood bleached TMP fibers (CSF 50 mL)

Softwood bleached TMP fibers (CSF 50 mL)

Softwood kraft fibers (CSF 250 mL)

CELLULOSE-REINFORCED HIGH MINERAL CONTENT PRODUCTS AND METHODS OF MAKING THE SAME

CROSS REFERENCE TO RELATED APPLICATION

This application claims priority under 35 U.S.C. 119 (e) from U.S. Provisional Application 61/388,939 filed Oct. 1, 2010.

BACKGROUND OF THE INVENTION i) Field of the Invention

The invention relates to pulp furnish having a mineral filler content from 50 to 90%, by weight, based on total solids, for papermaking; paper sheet having a filler content from 40 to 90%, by weight; and process of making filled paper from the pulp furnish.

ii) Description of the Prior Art

The paper, paperboard and plastic industries produce rigid and flexible sheets for a large variety of uses. The plastic sheets are normally more flexible, tear resistant and stretchable, and more dense and slippery than paper sheets, while common base paper sheets are normally more porous and much less water resistant. For purposes of handling and printing thereon, paper sheets are normally much more attractive than plastic sheets. In order to impart the plastic sheet with some characteristics of paper the addition of mineral fillers is required. The incorporation of inorganic fillers into thermoplastic polymers has been widely practiced in industry to extend them and to enhance certain properties, namely opacity and brightness, and also to lower the material cost. U.S. Pat. No. 6,054,218 describes a method to produce a sheet made of plastic material and inorganic filler which feels like and has at least some of the properties of paper. The filled plastic sheet according to the invention comprises a multilayer structure having an outer layer, a middle layer, and an inner layer. The layers comprise different proportions of polyethylene, filler namely calcium carbonate, and pigments namely titanium dioxide and silicate adapted to give a feel of paper to the multilayer sheet.

The process to produce the filled plastic paper comprises the co-extrusion and calendaring steps of a thermoplastic polymer such as polyethylene and inorganic fillers and pigments at a temperature higher than the melting point of the thermoplastic polymer, which can be as high as 200 deg. C. A product of this nature has been manufactured by A. Schulman Inc. and marketed under the trademark Papermatch®. The manufacturer claims that the process can be used for manufacturing packaging applications, and for labels, envelopes, wall paper, folders and a variety of other products. Natural Source Printing, Inc. at present commercializes FiberStone® Paper, which is also designated as stone paper or rock paper. According to published sources of this company the stone paper made from polyethylene combined with up to 80% calcium carbonate fillers can be employed as a substitute for traditional papers used in the printing industry, such as synthetic paper and film, premium coated paper, recycled paper, PVC sheet, labels, and tags. Being impervious to water the stone paper can also be very useful for outdoor applications.

While the above stone papers have the advantages of being made without the use of ligo-cellulose fibres and water, they present some major drawbacks: high amounts of petroleum oil-based polymers, high density and low stiffness. They can be neither recycled, nor biodegradable. The analysis of some commercial stone papers revealed that the sheets are multilayered structures with 54 to 75% inorganic material and the rest is thermoplastic polymer namely high density polyethylene (HDPE) and coating material. Depending on the level of inorganic material used with thermoplastic the density of sheets is in the range of 0.9-1.4 g/cm$^3$. In order to achieve the required values of opacity, bulk, stiffness and strength the sheets have to be made with high basis weights (200 to 300 g/m$^2$ or more.) The basis weight or grammage is the weight per unit area of sheet. Bulk is a term used to indicate volume or thickness in relation to weight. It is the reciprocal of density (weight per unit volume). It is calculated from calliper and basis weight of sheet: Bulk (cm$^3$/g)=Calliper (mm)*Basis Weight (g/m$^2$)*1000. Decrease in sheet bulk or in other words increase in density makes the sheet smoother, glossier, less opaque, and lower in stiffness. Yet, in many applications, such as those used in copy printers, the most critical property is the stiffness of sheet, which is heavily reduced as the density is increased.

Because of the general disadvantages of the plastic-based stone paper described above, there is a need to produce super-filled sheets from renewable, recyclable, biodegradable and sustainable materials and using the conventional papermaking process. The super-filled sheets must also have low density and the required bulk, opacity, and strength properties even when they are produced at basis weights half of those commercially available plastic-based stone paper sheets. Normal printing fine papers made with filler contents up to 28% have specific densities ranging between 0.5 and 0.7 g/cm$^3$, which are almost half of the plastic-based stone papers. For some applications the super-filled sheets need to have water resistant characteristics.

Inorganic (mineral) fillers are commonly used in manufacturing of printing papers (copy, inkjet, flexo, offset, gravure) from aqueous dispersions of wood pulp fibers to improve brightness and opacity, and achieve improvements in sheet print definition and dimensional stability. The term "fine" paper is used in the conventional industry sense and includes tablet, bond, offset, coated printing papers, text and cover stock, coated publication paper, book paper and cotton paper. The offset fine paper is surface sized with a formulation mainly composed of starch and hydrophobic polymer, such as styrene maleic anhydride, after the paper web has been dried. The internal filler levels in normal fine papers may range from 10 to 28%. As fine paper suitable for offset and gravure printing must have sufficient strength to withstand the high speed printing operation, it has been found that the existing papermaking technologies are not suitable to make them with a filler level higher than 30%.

Paperboard base sheets are made up of one or more fibrous layers or plies and generally with no filler addition. Depending on the end-use; paperboards are classified as: 1) carton board (various compositions used to make folding boxboard and set-up/rigid boxes); 2) food packaging board (used for food and liquid packaging); and 3) corrugated board (used for containers consisting of two or more linerboard grades separated by corrugated medium glued to the liners). Depending on application, the surface finish of the product is often obtained by single or double coating using known formulations which may be composed of inorganic fillers and pigments, binders and barrier polymers. Some packaging grades have their surfaces covered by polymeric films to impart high barrier properties to gas, water vapour or liquids. Paperboard base sheets are made almost exclusively from virgin and recycled fibres and additives. For some white toped multiply grades a very limited amount of inorganic filler (around 5%) is sometime introduced to the top ply sheet to improve opacity and print quality.

Making paper or paper board with high internal filler levels similar to those of plastic-based stone paper and having the required properties could be a means for making low cost green products for a variety of applications namely printing papers, flexible packaging, labels, tags, maps, bags, wall papers and other applications. The cost of papermaking fillers, such as precipitated calcium carbonate (PCC), ground calcium carbonate (GCC), kaolin clay, talc, precipitated calcium sulphate (PCS) or calcium sulphate (CS), is generally lower than the cost of cellulose fibres. The savings for the papermaker to produce one ton of paper can be substantial if the filler can be used to replace large quantities of expensive purchased kraft fibres. Because filled paper web is much easier to dry than paper web made with no filler, drying energy is lower. Since high filler addition will substantially improve the opacity of sheet, it might be possible to obtain this desired property at lower basis weight. Moreover, a filled base paper requires less coating material to achieve the required quality of normal coated grades.

The common method of introducing filler to paper sheet is by metering the filler slurry to a pulp suspension of about 1 to 3% consistency at locations such as in a machine chest or at the inlet of the fan pump, prior to the head box of the papermachine. The filler particles normally have a similar negative charge to that of fibres and thus have little propensity to adsorb onto the fibre surfaces. As a result, retention of filler particles with pulp fibres during sheet making is difficult to achieve, especially on high speed modern paper machines where furnish components experience large shear forces. Therefore, a polymeric retention aid system is always added to the diluted papermaking furnish, prior to the headbox of the papermachine, to enhance filler retention by the known agglomeration and flocculation mechanisms. However, with the existing retention aid technologies, achieving high filler retention without impairing sheet formation or structural uniformity is still a major challenge. For example, on a modern fine paper machine running at a speed of 1400 m/min, first-pass filler retention is about 40-50%. This means that only about half of the amount of filler in the furnish is retained in the sheet during its formation and the remaining portion drains with process water, which is often referred to by the term white water. In many mills paper machine runnability problems, high sewer losses of filler, holes in sheet and increased cost of functional additives (sizing, optical brightener, starch), have been associated with poor filler retention and accumulation of filler in the white water system.

In the art of papermaking once the moist web is formed it will requires adequate wet-web strength for good runnability on the paper machine. The dry sheet will require high Z-direction strength, tensile strength and stiffness for runnability on printing presses and copiers, and for other end uses. It is well known that the major obstacle to raising filler content in printing grades to higher levels is limited by the deterioration of these strength properties. Because filler does not have bonding capacity, inclusion of filler in paper impedes fibre-fibre bonding. On adding filler to sheet, tensile strength and elastic modulus are inevitably reduced by replacement of fibres by filler particles; not only are there fewer fibres in the sheet, which reduces the strength of fibre-fibre bonds, but also the presence of filler reduces the area of contact and prevents intimate bonds from occurring between fibres. As a result, filler addition drastically reduces wet web strength. A wet paper containing a high amount of filler can break more easily at the open draws of a paper machine. Therefore, strong wet web is an important criterion for good paper machine runnability. Fillers are denser than fibres and thus their addition will also reduce sheet bulk, which is essential for bending stiffness. Poor bonding of filler particles in the fibrous structure can also increase surface dusting in offset printing.

It is well known that the strength of paper sheet is affected by the length and surface area of fibres which influences the relative bonded area in the fibre network. The bonded area can be increased by fibre refining and by the web consolidation in the press section of the paper machine. Increasing bonding area by pressing and fibre refining can increase the internal bond strength and tensile strength of sheet, but at the expense of its bulk. At a given basis weight a decrease in sheet bulk may reduce bending stiffness. However, despite these possible negative effects on bulk and stiffness, in recent years good fibre development by refining and better forming and pressing techniques have improved the strength of filled sheets, and most fine paper manufacturers have now the possibility to increase filler contents in their grades by a few percent points ["Practical ways forward to achieving higher filler content in paper", C. F. Baker and B. Nazir, Use of Minerals in Papermaking, Pira Conference, Manchester February 1997)].

Another well known method to increase paper strength, but without changing the density of the sheet, is the addition of natural and synthetic polymers. They are commonly added in small proportions, which may range from 1 to 20 kg/ton of paper, to the aqueous pulp furnish, or applied on the sheet surface after the paper web has been dried. The performance of cationic strength polymers is often low when added to long fibre furnish such as kraft fibre because of its low negative charge and area of surface available for adsorption of the polymers. The performance can be completely impaired when cationic polymers are introduced to aqueous pulp furnishes having unfavourable chemistry conditions, such as high levels of anionic dissolved and colloidal substances and high conductivity.

Despite the progress in papermaking techniques and chemistries, the current filler content in all uncoated fine paper sheets is often below 30% of the paper weight. By using the conventional technologies, attempts to increase the filler content of these grades to higher levels result in insufficient filler retention, wet-web strength, tensile strength, and stiffness, and lower surface strength. An adequate surface strength is required for preventing dusting and linting when running on a high speed printing press, namely during offset printing.

In recent years several patents have been granted for making highly filled papers. U.S. Pat. No. 4,445,970 teaches a method to make printing fine paper suitable for offset and gravure printing at high speeds and containing high filler levels for a wide range of basis weights. High filler levels were achieved with high basis weight sheets, e.g., over 120 $g/m^2$. These highly-filled fine papers were produced on a low speed Fourdrinier paper machine from a furnish containing large quantities of filler, preferably a mixture of clay and talc, and including 3-7% of an cationic latex which is selected to provide good retention and good strength without leaving a residue on the screen. Fine paper sheet of 120 $g/m^2$ made by this invention with 46% filler has a tensile strength of 0.665 km. This tensile strength is considered to be very low when compared with a normal fine paper of 73 $g/m^2$ made with 20% filler which has a tensile strength of about 6.0 km. Despite the addition of very high dosage rates of cationic latex the filler content in paper achieved by the invention of this patent U.S. Pat. No. 4,445,970 is still below 50%.

A number of prior patents disclose the general idea that strength of paper can be increased by addition of cationic latex to the paper-making furnish. Because of the basic electro-chemical properties of anionic furnish components, cationic latex interacts with fibre surfaces to provide additional fiber bonding and, accordingly, strength to the resultant paper. These patents relate primarily to so-called "high-strength" papers which are largely devoid of fillers, or at best contain only very small quantities of fillers. For example, U.S. Pat. No. 4,178,205 Wessling et al discusses the use of cationic latex, but pigment is not essential. U.S. Pat. No. 4,187,142 Pickleman et al discloses the use of an anionic polymer co-additive with cationic latex, with the use of a sufficient amount of latex to make the entire paper-making system cationic; the use of fillers is not mentioned in any example. Foster et al U.S. Pat. No. 4,189,345 discusses extremely high levels of cationic latex.

U.S. Pat. No. 4,181,567 Riddell et al relates to the manufacture of paper using an agglomerate of ionic polymer and relatively large quantities of filler. The patentees indicate that either anionic or cationic polymers may be used, and fillers mentioned are calcium carbonate, clay, talc, titanium dioxide and mixtures. In example 1, an 80 g/m$^2$ basis weight paper having 29% filler is produced using calcium carbonate as the filler. This patent in essence discusses precipitation of the pigment with a retention aid system prior to its addition to the furnish composition.

It has been known in the paper Industry that the addition of anionic latex to the wet end of a paper machine combined with cationic chemical, such as alum, causes the anionic latex to precipitate in the presence of the fibers and fillers and thereby gives the paper increased strength. This procedure is normally used in the manufacture of certain so-called "high-strength" products such as gasket material, saturated paperboard, roofing felt, flooring felt, etc. No similar technique has heretofore been suggested for the manufacture of paper sheets having quantities of filler up to 90%.

It has been proposed noting U.S. Pat. No. 4,225,383 McReynolds in the manufacture of relatively thick paper product, similarly to the manufacture of roofing and flooring felt papers, to use the combination of a cationic polymer with anionic latex, and substantial quantities of mineral filler. However, the product is not designed for printing papers, and its strength requirements are accordingly relatively low. Moreover, because of the substantial heaviness of the paper produced by such a technique, the additional strength is originated merely by means of its mass.

Several other patents, including, U.S. Pat. No. 4,115,187, U.S. Pat. No. 5,514,212, GB 2,016,498, U.S. Pat. No. 4,710,270, and GB 1,505,641, describe the benefits of filler treatment with additives on retention and sheet properties. It is known that since most common inorganic filler particles in suspension carry a negative charge, the cationic additive adsorbs on their surfaces by electrostatic interactions causing them to agglomerate or flocculate. For anionic additives to promote flocculation the filler particles would require a positive charge to allow adsorption of the anionic additive. The aggregation of filler particles improves retention during sheet making and can also decrease the negative effect of filler on sheet strength, but excessive filler aggregation can impair paper uniformity and also decrease the gain in optical properties expected from the filler addition. The filler content achieved by these patents is below 40%.

In U.S. Pat. No. 7,074,845 Laleg anionic latex has been used in combination with swollen starch for preparing treated filler slurries to be added internally in paper manufacture. The swollen starch/latex compositions are prepared by pre-mixing latex with slurry of starch granules in a batch or jet cooker, or by adding hot water to the mixture under controlled conditions in order to make the starch granules swell sufficiently to improve their properties as a filler additive but avoid excess swelling leading to their rupture. The anionic latex interacts with cationic swollen starch granules forming an active matrix. The composition is rapidly mixed with the filler slurry, which increased filler aggregation. The treated filler is then added to the papermaking furnish prior to sheet making. The retention of treated filler prepared by this process, in the web during papermaking was improved and the filled sheets have a higher internal bond and tensile strength than filled sheets produced using the conventional addition of cooked starch to the furnish.

International Publication Number WO 2008/148204 Laleg et al discusses a method to increase strength of filled paper sheet by continuous treatment of filler slurry to enhance the fixation of anionic latex on precipitated calcium carbonate particles in a short time. In this process anionic latex is added to filler slurry at ambient temperature and then mixed with water having a temperature higher than the glass transition temperature ($T_g$) of the latex used. To efficiently fix the latex the temperature of the filler/latex mixture must be 20-60° C. higher than the $T_g$ of the latex used. The anionic latexes applied by this process are totally and irreversibly fixed or bound onto the filler particles and the aggregated filler slurry is stable over time. In this invention the latex-treated filler slurry is designed for addition to papermaking furnishes at any point prior to the headbox of the paper machine or stored for later use. The latex-treated filler slurry improved filler retention, greatly prevented loss of sheet strength and improved performance of internal sizing agents.

In U.S. Pat. No. 5,824,364, calcium carbonate crystals are disclosed as being directly formed onto fibre fibrils by a precipitation procedure of calcium hydroxide and carbon dioxide without addition of fixing agents. The calcium carbonate filler contained in the sheet is limited to the available surface area of the fibre fibrils, as specified by the inventors, in the range of 3-200 m$^2$/g. The objective of this prior art method was to achieve high filler retention by focusing on individual sections of the fibres, such as in the lumen, cell wall, or fibrils. The filler content in paper achieved by this invention was below 30%. In this patent no latex or other chemical agents were used to assist filler fixation on fibrils surface and to improve bonding.

FI 100729 (CA 2,223,955) discloses filler for use in papermaking, the filler comprising porous aggregates formed from calcium carbonate particles deposited on the surface of fines. According to the patent specification, this filler of a novel type is characterized in that the fines are made up of fine fibrils prepared by beating cellulose fibre from chemical or mechanical pulping. The size distribution of the fines fraction mainly corresponds to wire screen fraction P100. The paper filler content reached by this approach or by a similar approach described in U.S. Pat. No. 5,824,364 and US 2003/0051837 was around 30% and the strength properties were only slightly higher than those measured on sheets produced by conventional methods of filler addition.

While the above methods are claimed to help produce sheets having high filler content and with acceptable strength, any attempt to raise the filler to high levels up to 50% or more has never been made on a conventional paper machine or commercially. Poor filler retention, weak wet web and dry strength and low paper stiffness remain as major obstacles for papermakers. Obviously there is still a need for a technology to fabricate super filled pulp fibrous sheets without the papermaking problems mentioned above. It would be very useful if a simple composition could be conceived to permit fixing large portions of filler particles on fibrous surfaces and act as glue or binder and load bearing transfer between the materials that form the final paper product. It would be more practical, for some applications, if the final product has some barrier and water resistance characteristics.

SUMMARY OF THE INVENTION

It is an object of this invention to provide a pulp furnish for papermaking comprising: fibrillated long fibers and filler particles in an amount of up to 90%, by weight, based on total solids, for use to produce highly-filled paper sheets.

It is an object of this invention to provide a process for making a paper having a filler content up to 90%, by weight.

It is another object of this invention to provide a paper having filler content up to 90%, by weight.

In one aspect of the invention, there is provided a pulp furnish for papermaking comprising: fibrillated long fibres, filler particles and an anionic binder, in an aqueous vehicle, said filler particles being in an amount of up to 90%, by weight, based on total solids.

In another aspect of the invention, there is provided a process of making paper comprising forming an aqueous pulp papermaking furnish comprising fibrillated long fibres, filler particles and an anionic binder, in an aqueous vehicle, said filler particles being in an amount of up to 90%, by weight, based on total solids, mixing the pulp furnish and subjecting the mixing pulp furnish to a temperature higher than the $T_g$ of the anionic binder to fix the filler particles and binder on the fibres, draining the pulp furnish through a screen to form a sheet, and drying the sheet.

In a particular embodiment, common papermaking additives may be added to the pulp furnish in a) or b).

In still another aspect of the invention, there is provided a paper comprising a matrix of fibrillated long fibres, filler particles and an anionic binder, said filler particles being in amount up to 90%, by weight, of the paper; and said filler particles and binder being fixed on surfaces of said fibrillated long fibres.

In preferred embodiments, the fibrillated long fibres/filler furnish and the super-filled paper made from this furnish of the invention further comprise high surface area cellulose fibrils such as cellulose nanofilaments (CNF), microfibrillated cellulose (MFC), and/or nanofibril cellulose (NFC). The introduction of CNF, MFC or NFC to the pulp furnish provides high surface area for greater filler fixation and enhances the consolidation of the paper structure. The preferred cellulose fibrils for this invention are those made from wood fibres or plant fibers and are long threadlike and thin in diameter.

DETAILED DESCRIPTION OF THE INVENTION

The invention provides a novel method to prepare aqueous composite formulations of fibrillated long fibres/mineral filler mixed with anionic binder and optionally papermaking additives, in absence or presence of cellulosic fibrils (CNF, MFC or NFC), at a mixing temperature higher than the Tg of the anionic binder, and useful for making paper products having up to 80% mineral filler and the required physical properties for the intended applications. The aqueous composite formulations can also be used to fabricate, on existing conventional equipment, paperboard, packaging and moulded shaped items.

At no point did any of the prior art patents or publications in the open literature disclose or discuss aqueous compositions of fibrillated long fibres and fillers mixed with specific binders at mixing temperature higher than the Tg of the used binder, optionally with high surface areas cellulosic fibrils such as CNF, MFC or NFC, for making products, namely sheet, matt, paper, paperboard packaging and moulded items, containing up to 90% filler and having the required physical properties for the intended applications.

The present invention overcomes the above described disadvantages of the prior art by a method which satisfies the conditions to produce on existing machines, super filled products having filler contents up to 90% by weight of total solids. The present invention provides technology to produce these super filled products from aqueous compositions where the fixation of a large amount of filler particles on high surface fibrous materials is realized in order to increase filler retention and to reduce the strength loss on high filler addition. Conventional surface treatment techniques, namely pond size press, metering size press or coaters can be successfully used to further enhance strength and impart water resistance.

Generally the invention seeks to exploit high filler content, especially up to 90% filler by weight of total solids in the furnish, or up to 90% based on the dry weight of sheet or paper. However the invention can also be employed for lower filler contents.

The present invention in specific and particular embodiments is based on medium consistency mixing of filler, for example precipitated calcium carbonate or calcium sulphate, with fibrillated long fibres, preferably combined with CNF, MFC or NFC with or followed by the addition of an anionic binder and optionally other functional and process additives commonly used in paper manufacture including starch, sizing agent, cationic agent, and drainage and retention aids. The aqueous compositions prepared at total consistencies up to 10% solids are sheared in a mixing tank, mixing pump or preferably in a refiner at temperatures higher than the Tg of the binder.

In the mixing under shear at a temperature higher than the $T_g$ of the anionic binder a simultaneous action of filler particles aggregation and their fixing or binding on the fibrous surfaces take place, removing the filler particles and the binder from the aqueous vehicle of the furnish. The conventional papermaking co-additives are added to the furnish comprising fibrillated long fibers, cellulose fibrils (CNF, MFC or NFC), fillers and anionic binder prior to product formation. The resulting super-filled sheets can be further surface-treated on conventional sizing or coating equipment to develop products such as composites and packaging materials with functional properties suitable for the intended applications. At equal filler contents, the super-filled sheets produced by this invention can have calipers similar to those of plastic-based stone papers at much lower basis weights, and yet have higher values of opacity, brightness, tensile strength, and stiffness.

The fibrillated long fibers to be used in the production of the super-filled sheets of this invention could be those processed from wood, similar to those used conventionally in manufacture of paper and paperboard materials. Fibrillated long fibres made from softwood trees are more preferred for this invention.

Some plant fibers such as hemp, flax, sisal, kenaf and jute, and cotton and regenerated cellulose fibres, may also be used for reinforcement of the super-filled sheets. Regenerated cellulose fibers such as rayon fibers can be made in dimensions similar to cotton fibers, and be used for fibrillated long fibers as well. However, length optimization and refining of these thick-long fibers is required for efficient application and maximizing performance.

The performance of cellulose fibres for making strong paper sheet can be substantially improved if their surface area is increased and length preserved by exposing more fibrils on the surface of long fibres during thermo mechanical refining or beating of the pulp fibres.

In the art of papermaking, it is well known that refining of pulp fibres causes a variety of simultaneous changes to fibre structure such as internal and external fibrillation, fines generation, fiber shortening, and fiber curl. External fibrillation is defined as disrupting and peeling-off the surface of the fibre leading to the generation of fibrils attached to the surface of the fibres. External fibrillation also leads to large increase in surface area (Gary A. Smook, *Handbook for Pulp and paper Technologists, 3rd edition*, Angus Wilde Publication Inc., Vancouver, 2002). Paper made from the highly fibrillated fibres has high tensile strength while fibre shortening would adversely affect tear strength, and web drainage behavior on the paper machine therefore, papermakers often carefully refine the pulp to a drainage characteristic which is most favorable to the paper machine runnability (Colin F. Baker, Tappi Journal, Vol. 78, N0.2-pp 147-153). Yet, in the present invention these well developed fibers were found to present an excellent opportunity to manufacture super-filled paper when the drainage problem is overcome by high filler addition and the filler particles were essentially well fixed on the fibrous surfaces by the introduction of an anionic binder having a Tg lower than the furnish temperature.

The microfibrillated cellulose (MFC), introduced first by Turbak et al. in 1983 (U.S. Pat. No. 4,374,702), has been produced in homogenizers or microfluidizers by several research organizations and is also commercially manufactured on a small scale. Japanese patents (JP 58197400 and JP 62033360) also claimed that microfibrillated cellulose produced in a homogenizer improves paper tensile strength. More information on microfibrillated cellulose and cellulose nanofibrils can also be found in these two references: "Microfibrillated cellulose, a new cellulose product: Properties, uses, and commercial potential." *J. Appl. Polym. Sci.: Appl. Polym. Symp.,* 37, 813.) and "Cellulose nanofibrils produced by Marielle Henriksson (PhD Thesis 2008—KTH, Stockholm, Sweden: Cellulose Nanofibril Networks and Composites, Preparation, Structure and Properties) from a dissolving pulp pretreated with 0.5% enzymes then homogenized in the Microfluidizer had a DP 580.)

The above mentioned product, MFC is composed of branched fibrils of low aspect ratio relatively short particles compared to original pulp fibres from which they were produced. They are normally much shorter than 1 micrometer, although some may have a length up to a few micrometers.

Microfibrillated cellulose or nanofibril cellulose described in the above and following patents may be used in this invention for reinforcement of super filled sheets: U.S. Pat. No. 4,374,702, U.S. Pat. No. 6,183,596, U.S. Pat. No. 6,214,163, U.S. Pat. No. 7,381,294, JP 58197400, JP 62033360, U.S. Pat. No. 6,183,596, U.S. Pat. No. 6,214,163. U.S. Pat. No. 7,381,294, WO 2004/009902, and WO2007/091942. However, the most preferred reinforcement component is cellulose nanofilaments (CNF) produced in accordance with U.S. Ser. No. 61/333,509, filed May 11, 2010 Hua et al. The CNF are composed of individual fine filaments (a mixture of micro- and nano-materials) and are much longer than NFC, and MFC as disclosed in the above patents. The lengths of the CNF are typically over 100 micrometers, and up to millimeters, yet can have very narrow widths, about 30-500 nanometers, and thus possess an extremely high aspect ratio. These materials were found extraordinarily efficient for reinforcement of paper (for improving both wet-web and dry paper strengths). Introducing a small quantity of this CNF such as 1 to 5%, into paper pulp greatly improved the inter-fiber cohesion strength, the tensile strength, the stretch, and the rigidity of the sheet. Therefore, application of fibrillation of long fibres and high-surface-area cellulose fibrils, especially CNF, may be very useful for the reinforcement of super filled papers.

The filler level of sheet to be achieved by this invention significantly depends on the proportions of fibrillated long fibres and cellulose fibrils, the binder type, its dosage and mode of application. The preferred fibrillated long fibres to be used in this invention can be softwood kraft pulp, softwood thermo-mechanical pulp or their blends. A small fraction of other optimized long fibres, such as hemp, kenaf, cotton, rayon or synthetic polymer fibres that need to be processed to suitable length and fibrillation levels, may also be added along with softwood pulp fibres, to impart some functional characteristics to the super-filled products. The most preferred fibrillated long fibres are those readily available well developed fibres such as bleached softwood thermo-mechanical pulp commonly used in manufacture of supercallendared paper grades, and bleached softwood kraft fibres produced by using the known papermaking refining conditions that develop external fibrillation without fibre shortening, either in a high consistency or a low consistency refiner. Highly fibrillated thermomechanical pulp produced by low intensity refining as described in U.S. Pat. No. 6,336,602 (Miles) allow applying more energy than conventional refining method to promote fiber developments instead of fiber cutting.

The procedure of the invention can be commercially applied by performing the following steps. To the mixing fibrillated long fibre/cellulose fibres (such as CNF) slurry at consistency 2-4% and temperature 20-60 deg C., an amount of filler namely precipitated calcium carbonate or gypsum, preferably made without an anionic chemical dispersant, is added, and mixing continued. Some filler particles tend to adsorb on the fibrils surfaces, but a large portion of filler remain dispersed in water. The mixture is then treated with the anionic binder at a temperature higher than its Tg to complete filler fixation on fibrous surfaces. On adding the anionic binder at temperature higher than its Tg the process water becomes free of filler and binder particles indicating that filler and binder are both well fixed on cellulose surfaces. The preferred binders are anionic acrylate resins commercially available from companies like BASF having a particle size of 30 to 200 nm or more and Tg ranging between −3 and +50° C. (US 2008/0202496 A1, Laleg et al). To the treated aqueous composition some co-additives or conventional functional additives can be added, namely cationic starch, chitosan, polyvinylamine, carboxy methyl cellulose, sizing agents, and dyes or colorants. Other common functional additives such as wet strength agent and bulking agent (e.g. thermoplastic microspheres made by Eka Chemicals) can also be added to control sheet resistant when in contact with polar liquids, and calliper, respectively. Depending on the end uses the super filled sheets can be surface treated using conventional size presses, such as a pond size press, or conventional coaters to develop some specific properties. The surface treatment of the super-filled paper imparts high surface strength and hydrophobicity, and also introduces more filler to the final product.

The aqueous compositions prepared by this invention can be used to produce super filled sheets of basis weight ranging from 80 to 400 g/m$^2$, preferably from 100 to 300 g/m$^2$ and more preferably from 150 to 200 g/m$^2$, using the conventional papermaking processes. When the binder-treated aqueous composition of this invention is transferred to the paper machine chest, a conventional papermaking process additive, namely a retention aid system, is added to enhance filler retention during sheet formation. The retention aid system may suitably be composed of cationic starch, cationic polyacrylamide or a dual component system such as cationic starch or cationic polyacrylamide and an anionic micro-particle. The microparticle can be colloidal silica or bentonite, or preferably anionic-organic micro-polymers. These retention aids are added to the furnish prior to the headbox, and preferably to the inlet of fan pump or inlet of pressure screen of paper machine. The addition of co-additives to the furnish compositions of this invention followed by introduction of the retention aid system has been found to be an efficient way for achieving very high filler retention and strength development. By using the full procedure of this invention good filler retention and improved drainage during sheet making are well reached in order to make papers with filler content as high as 90%, for example as high as 80%, or more of the total weight of the sheet mass. Thus a typical paper of the invention may have a filler content of 40 to 80%, by weight.

As discussed above, when precipitated calcium carbonate is added to the fibrillated long fibers/cellulose fibrils, some particles tend to adsorb on these high area fibrous surfaces, but a large portion of particles remain dispersed in water. When the anionic binder is added it initially adsorbs on the filler particles (which are in aqueous solution or already fixed on fibrous surfaces) by electrostatic or hydrophobic interactions or by hydrogen bonding and simultaneously causing their fixation on fibrous surfaces. On heating the mixture at temperatures above the Tg of binder, the binder particles spread over the surfaces of filler particles causing their complete fixation on cellulosic fibrous surfaces. The adsorbed binder or latex spreads and strongly bind the filler particles together with fibrous surfaces, thereby reinforcing the paper composite and increasing its strength and other physical properties. Surface strength, paper porosity and smoothness are all improved. The degree of filler and binder fixation on cellulosic fibrous surfaces was found to be greatly dependent on furnish consistency, the dosage rate of binder and its Tg and the temperature.

When a binder of Tg ranging between −3 and 50° C., such as those of the resin series made by BASF under the trade marks Acronal®, is mixed, alone or in combination with an Acrodur® dispersion that develops rigid film at ambient temperature and above 50 deg. C., with an aqueous composition of fibrillated long fibers/cellulose fibrils/filler at furnish consistencies of 3 to 10% or more and temperature above the Tg of Acronal binder all the filler particles, such as PCC, tend to rapidly deposit on the high surface area cellulosic fibrous surfaces. This rapid adsorption or fixation of filler and binder is irreversible even under high shear mixing of the treated filler slurry for prolonged periods of time. This type of particle fixation on cellulosic fibrous surfaces is very different from that achieved with polymeric flocculants, which tend to flocculate all furnish components in large flocs and these flocs are generally very shear sensitive and time dependent or decay over mixing time. The level of anionic binder adsorption induced under the conditions used can be as high as 100 kg/ton of the amount of solid material of furnish (filler and cellulose) used, especially for furnishes made with addition of PCC, PCS or their blends, both made without chemical anionic dispersant. It was found that the higher the consistency of the furnish composition the better the binder adsorption and the greater the filler fixation on cellulose fibrous surfaces. Such induced binder adsorption and filler fixation caused very high filler retention and improved drainage of water during sheet making. For example, the filtrate water collected during sheet making is very clear indicating that the binder and filler are well retained in the sheet.

While the fixation of anionic binder according to this invention is complete when used with PCC, PCS and cationic talc or other cationic filler and pigment slurries, for anionically dispersed filler slurries such as GCC, clays, talc, $TiO_2$, cationic agents such as calcium chloride, zirconium compounds (zirconium ammonium carbonate, zirconium hydroxychloride, chitosan, polyinylamine, polyethylenimine, poly(dadmac), organic or inorganic micro-particles, may also be pre-mixed with these fillers to initiate fixation of anionic binder on their surfaces causing them to fix on fibrous surfaces and allow greater binder fixation.

Below is the description of the ingredients forming the aqueous compositions of pulp furnishes of the present invention:

Fibrillated long fibers: The preferred fibrillated long fibers for use in making the super filled sheets or items of this invention may be conventional externally fibrillated softwood kraft fibres, bleached softwood thermo-mechanical pulps, bleached softwood chemi-thermo-mechanical pulp, or their blends. The preferred softwood kraft pulp are those refined to Canadian Standard Freeness (CSF) value as low as 50-400 mL, and by way of example 200-400 mL using either a high consistency disc refiner or a low consistency disc refiner under conditions that favour external fibrillation and without fibre cutting (Colin F. Baker, Tappi Journal, Vol. 78, N0.2-pp 147-153, the teachings of which are incorporated herein by reference). CSF is used as an index by the industry to predict pulp drainage rate during sheet making The lower the number the more refined the fibres and thus the slower the drainage rate. The other preferred pulps are the well developed bleached thermo-mechanical pulps similar to those processed for the manufacture of super-calendared papers and have CSF values as low as 30-60 mL (U.S. Pat. No. 6,336,602 Miles, the teachings of which are incorporated herein by reference). A small fraction of non-wood source fibres such cotton, rayon or some annual plants can also be used in the composition to enhance some special properties of the final product. In order to efficiently use these long fibres in the compositions of this invention they are suitably processed to reduce their length to a range of 5 to 10 mm, and preferably refined according to Colin F. Baker (Tappi Journal, Vol. 78, N0.2-pp 147-153), the teachings of which are incorporated herein by reference, to develop external fibrillation.

Cellulose fibrils: Any cellulose based fibrils, such as CNF, MFC or NFC, can be used in this invention. However, the preferred fibrils are those of CNF described in the aforementioned U.S. Ser. No. 61/333,509, Hua et al. and MFC described in J. Appl. Polym. Sci. Appl. Polym. Symp., 37, 813, the teachings of both being incorporated herein by reference. The proportion of cellulose fibrils to fibrillated long fibre fraction can vary from 0 to 50%. The fibrillated long fibres and cellulose fibrils to be used by the present invention can be enhanced by modifying their surfaces with chemical agents, especially polymers or resins that have cationic or anionic functional groups. Examples of these chemical agents are chitosan, polyvinylamine, cationic starch, cationic polyvinylalcohol, cationic styrene maleic anhydride, cationic latex, carboxy methyl cellulose and polyacrylic acid.

Fillers: The fillers for use in this invention are typically inorganic materials having an average particle size ranging from 0.1 to 30 μm, more usually 1 to 10 microns, such as common papermaking fillers like clay, ground calcium carbonate (GCC), chalk, PCC, PCS, talc and their blends. The preferred fillers are those made without or with a low level of chemical anionic dispersants. The most preferred inorganic fillers for use with anionic binders are those naturally carrying a positive charge at their commercial slurry application such as PCC processed without chemical anionic dispersants. The proportion of filler to cellulose fibrous fraction may range from 50 to 90%. The filler will typically be in an amount of 50 to 90% or higher, by weight dry solids, of the furnish, and in an amount of 40 to 90%, such as 40 to 80%, by weight of dry paper. Typical papers of the invention may contain 50 to 70%, or 60 to 80%, or 50 to 80% or 60 to 70%, by weight of dry paper.

Binders: The binders to be used in this invention are usually produced by emulsion polymerisation of the appropriate monomers in the presence of a surfactant and the surfactant becomes adsorbed onto the polymerized resin particles. The surfactant, which forms a shell on the resin (latex) particles, often imparts a charge. An important embodiment of the present invention involves the use of anionic latex, zwitterionic or amphoteric latex (containing both anionic and cationic sites). The preferred binder dispersions include acrylic polymers, styrene/butylacrylate polymers, n-butyl acrylate-acrylonitrile-styrene and carboxylated styrene/butadiene polymers. The preferred Tg of the binders used in this invention varies between −3 to 50° C. and their average particle size ranges between 30 to 300 nm. The most preferred anionic binders of this invention are acrylic based products with Tg ranging from 0 to 40° C. and particle size between 60 and 200 nm. However, other water-based resin/binder system of higher film rigidity, such as those commercialized by BASF under the trade name Acrodur®, may be combined with the low Tg Acronal® binders to achieve stronger and stiffer filled paper. Acrodur® anionic dispersions are one-component binder systems consisting of a modified polyacrylic acid and a polyalcohol crosslinker. The dosage of the binder (based on the solid content) of the fibrillated long fibres/cellulose fibrils/fillers may range from 0.5 to 100 kg/ton of paper, but the preferred dosage ranges for high filler addition are between 10 and 20 kg/ton of paper. The most preferred dosage level of Acrodur dispersion is in the range of 2 to 4 kg/ton. The dosage of the binder is governed by the requirement that substantially all the binder particles become bound to filler particles and fibrous surfaces. In particular the filler particles are irreversibly bound by the binder to the fibrous surfaces, or agglomerates of filler particles are irreversibly bound by the binder to the fibrous surfaces; in the case of agglomerates, particles forming the agglomerates may be irreversibly bound in the agglomerates by the binder.

Co-additives: To the aqueous compositions produced by this invention may be added conventional papermaking agents or co-additives to improve fixation, retention, drainage, hydrophobicity, color, bulk, and bonding, for example polyvinylamine commercialized by BASF, any cationic starch or amphoteric starch, cationic sizing agent emulsions such as alkylketene dimer, alkenyl succinic anhydride, styrene maleic anhydride, and rosin; wet strength agents; dyes; optical brightener agents; bulking agent such as thermally expandable thermoplastic microspheres commercialized by Eka Nobel. The furnish may include a conventional retention aid system which may be a single chemical, such as an anionic micro-particle (colloidal silicic acid, bentonite), anionic polyacrylamide, a cationic polymer (cationic polyacrylamide, cationic starch), or dual chemical systems (cationic polymer/anionic micro-particle, cationic polymer/anionic polymer). The preferred retention aid system is similar to those commercialized by Kemira and BASF (and Ciba) where a combination of cationic polyacrylamide and anionic microparticle is used.

The aqueous composition made by the method of this invention can be used to make sheet using conventional papermaking techniques or moulding techniques, i.e. products formed on a forming fabric or a screen from aqueous composition drained, dried and eventually calendared. The dry super-filled paper can be surface treated on conventional size presses or coaters to impart additional surface characteristics.

Reference to amounts % herein are to be understood as %, by weight, unless indicated otherwise.

DETAILED DESCRIPTION OF THE DRAWINGS

Figure 1:
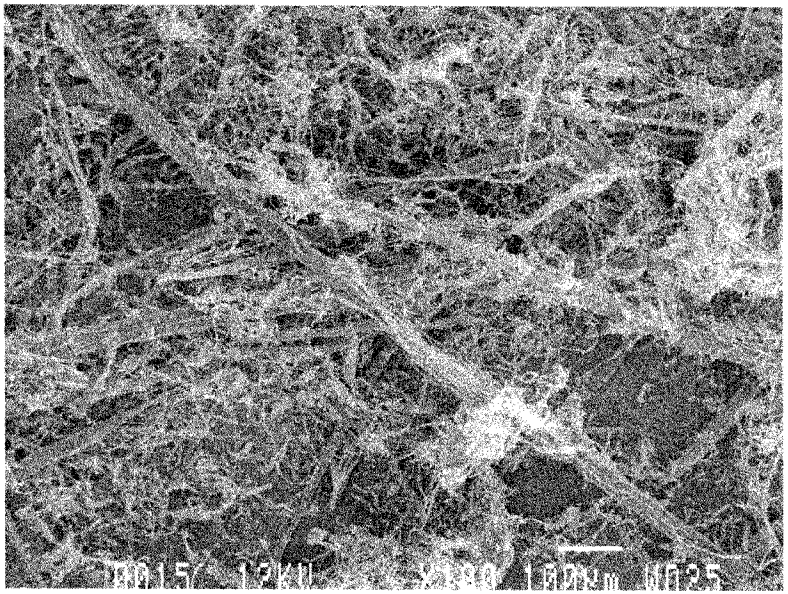
FIG. 1 is a Scanning Electron Microscopy (SEM) image showing typical fibrillated long softwood kraft fibres (CSF 250 ml) and softwood bleached thermo-mechanical pulp (TMP) fibres (CSF 50 ml) used according to this invention made by refining of softwood kraft pulp and softwood thermo-mechanical pulp.
Figure 1:
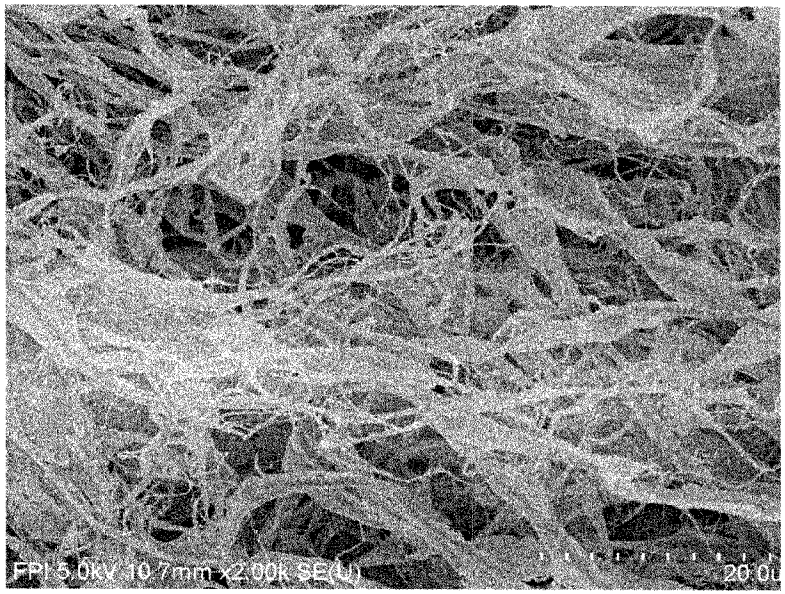
Figure 2:
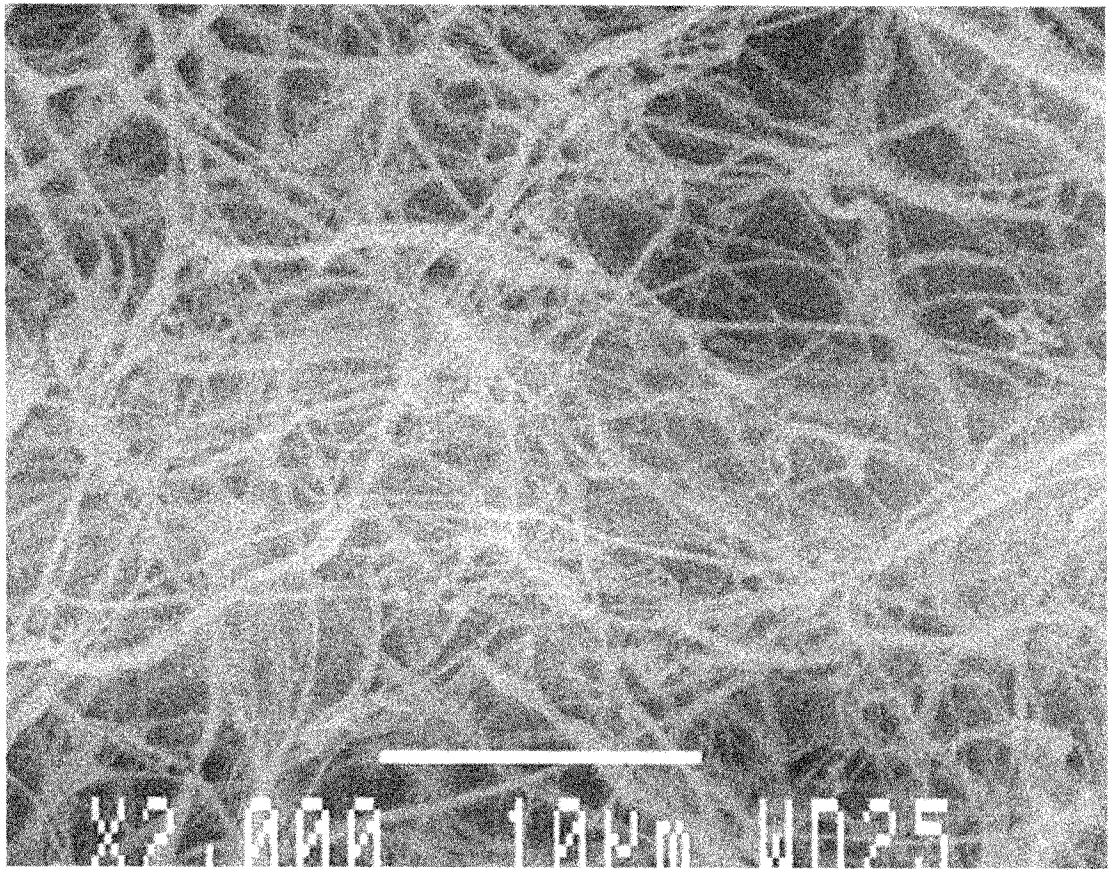
FIG. 2 shows an SEM image of CNF composed of the thin and long fibrils produced in accordance with U.S. Ser. No. 61/333,509, Hua et al.

With further reference to FIGS. 1 and 2, the thin width of fibrillated long fibres and cellulose fibrils enables a high flexibility and a greater bonding area per unit mass of the material. The high length and high surface area allow for the development of better entanglement and bonding sites for high tensile strength and stiffness of the filled paper composites. The high ratio of surface area to weight of the fibrillated long fiber and cellulose fibrils of this invention has been found very useful for making strong super-filled sheets.

Figure 3:
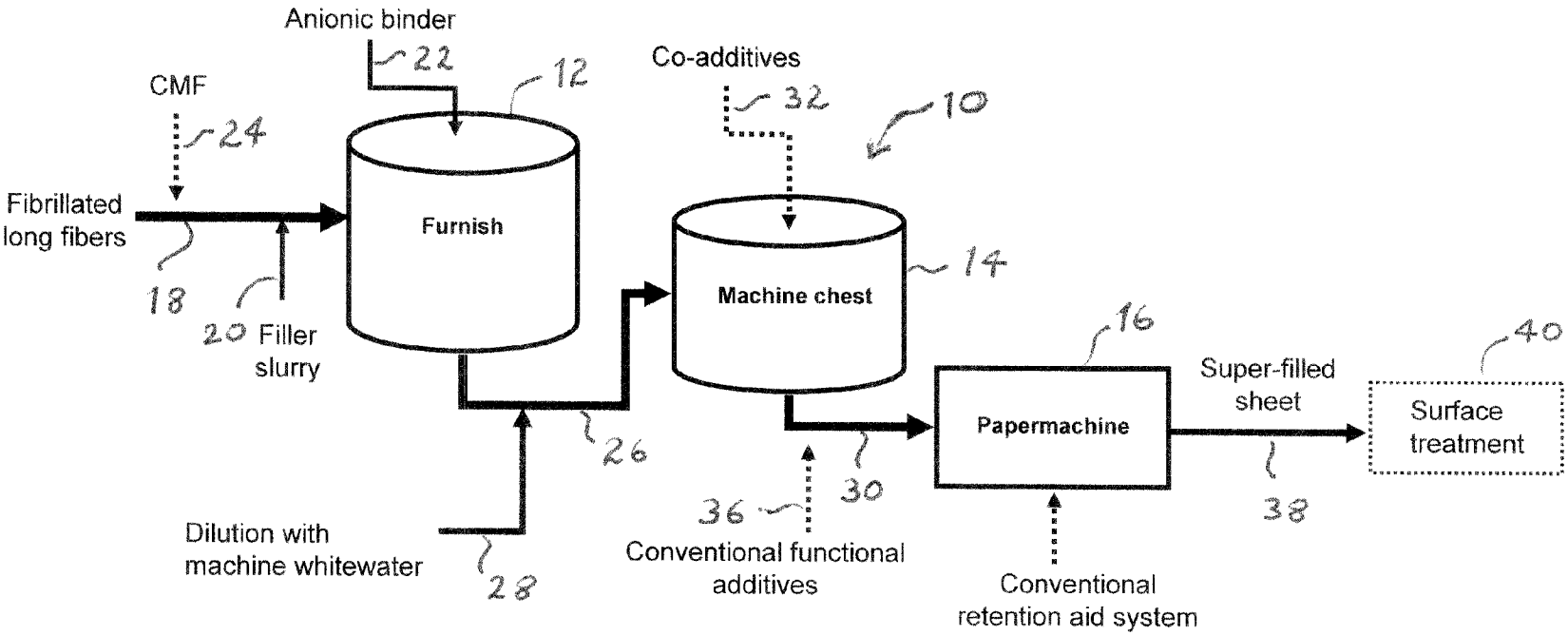
FIG. 3 illustrates schematically the process for the application of the aqueous compositions of this invention, in a particular embodiment.

With further reference to FIG. 3, sheets or items of different basis weight and filler content can be produced from the aqueous compositions according to the following procedure. To the fibrillated long fibres/filler compositions, in absence or presence of cellulose fibrils namely CNF, MFC, or NFC, are added anionic binder dispersions (Acronal and/or Acrodur) and conventional co-additives. The cellulose fibrils CNF produced according to invention of the aforementioned U.S. Ser. No. 61/333,509 Hua et al or MFC or NFC produced by the earlier mentioned references can be used as is or modified with cationic or anionic components. Before sheet making a retention aid system composed of cationic polyacrylamide and anionic micropolymer is added. The formed filled products can further be surface treated using conventional methods.

FIG. 3 shows an apparatus 10 having a furnish tank 12, a machine chest 14, and a papermachine 16. Furnish tank 10 has an inlet line 18 for fibrillated long fibres, an inlet line 20 for filler slurry and an inlet line 22 for anionic binder, as well as an optional inlet line 24 fibrils such as CNF. A line 26 communicates furnish tank 12 with machine chest 14. A dilution line 28 for machine white water communicates with line 26. Line 30 communicates machine chest 14 with papermachine 16. An optional inlet line 32 for co-additives communicates with machine chest 14. An optional line 34 for conventional functional additives for papermaking communicates with line 30. An optional line 36 for a conventional retention aid system communicates with papermachine 16. A superfilled sheet 38 exits from papermachine 16 and may pass to an optional surface treatment 40.

The furnish is formed in furnish tank 12 and fed to machine chest 14 where co-additives may be introduced to the furnish, and thence to the papermachine 16 for paper manufacture to produce the super filled sheet 38.

Figure 4:
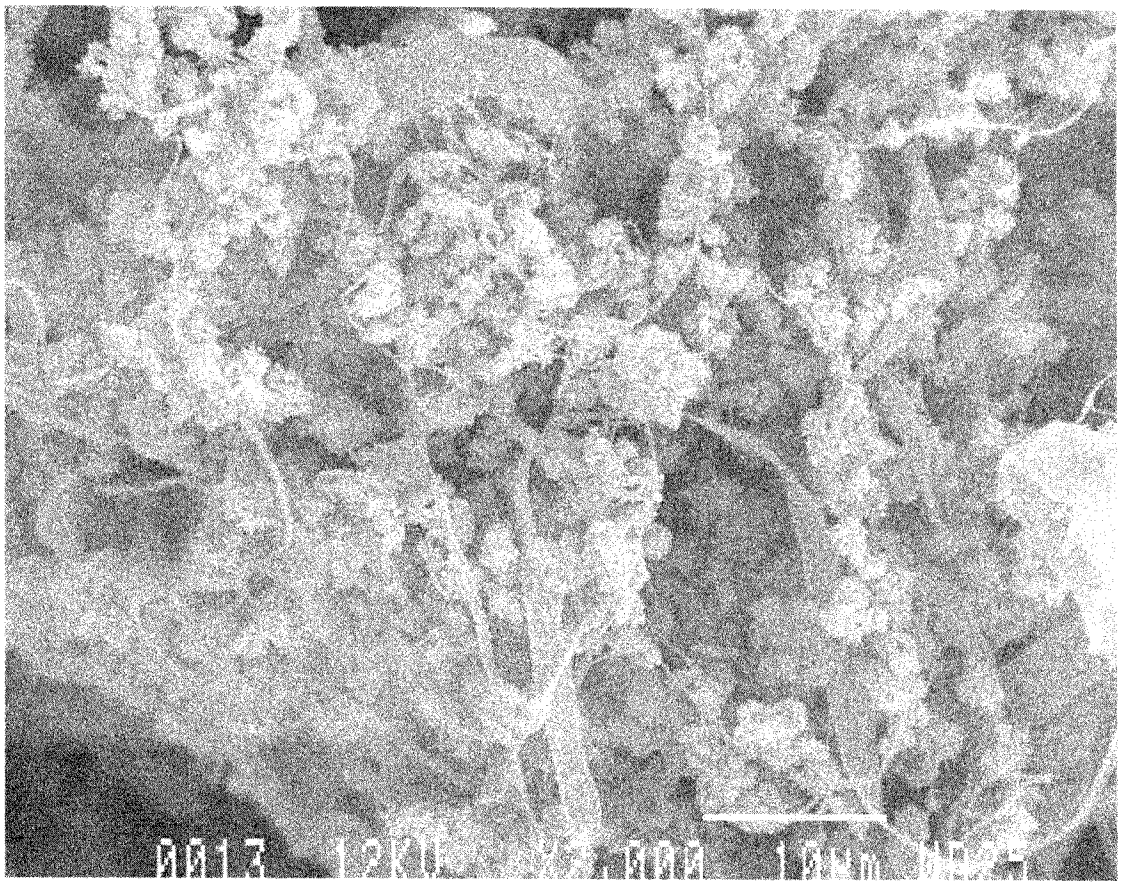
FIG. 4 shows a SEM image of PCC particles aggregated and fixed on surfaces of fibrillated fibers made of bleached thermo-mechanical pulp of freeness 50 mL.
Figure 5:
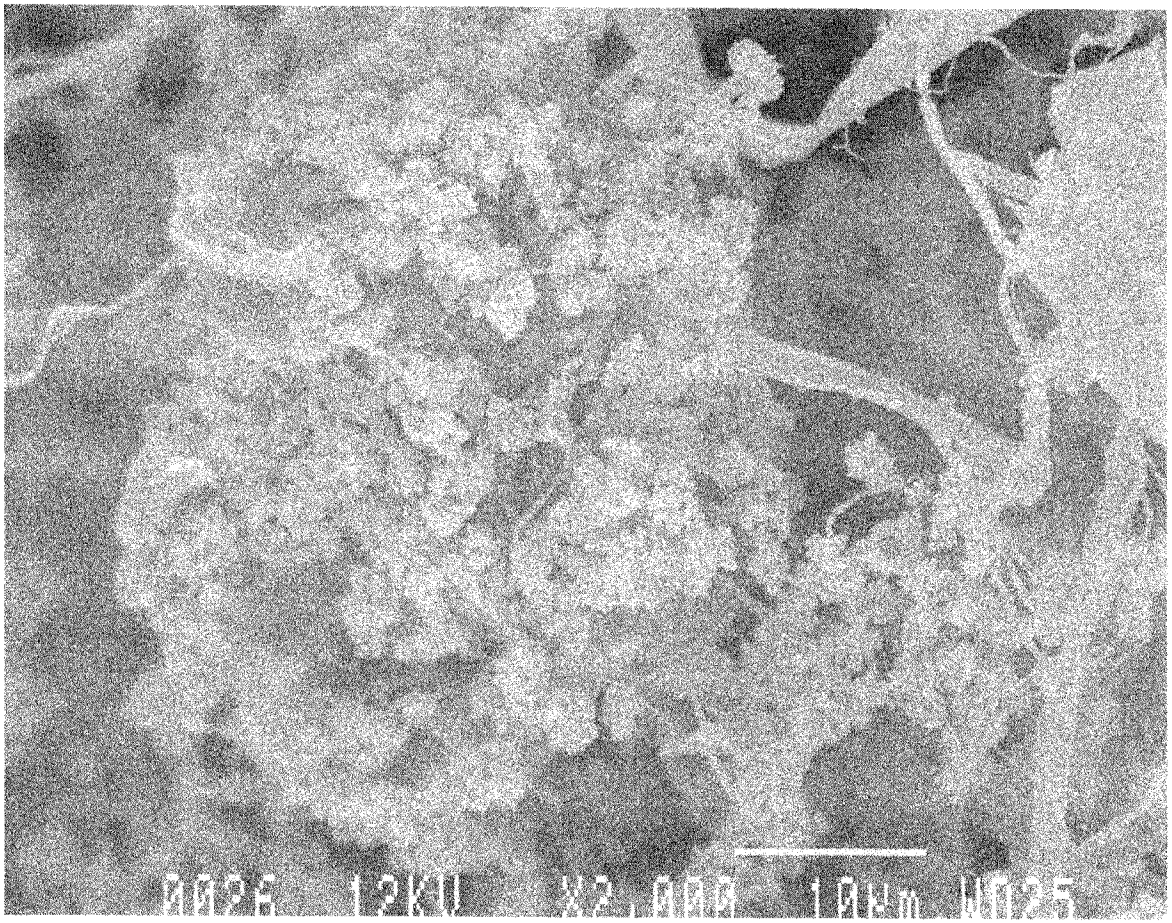
FIG. 5 shows a SEM image of PCC particles aggregated and fixed on surfaces of fibrillated fibers made of bleached thermo-mechanical pulp of freeness 50 mL of FIG. 4, but after the sample was subjected to shear mixing for 1 min in a dynamic drainage jar at 750 rpm.

With further reference to FIGS. 4 and 5, the addition of an Acronal binder (resin) of Tg=3 deg. C. to the aqueous composition of externally fibrillated bleached softwood thermomechanical pulp/PCC filler, in absence of cellulose fibrils CNF allowed excellent fixation of filler which resulted in high filler retention during sheet making. Using this approach pulps with extremely high levels of fixed PCC filler particles, for example, a filler:fibre ratio of 2:1, were produced. The super-filled sheet made from this aqueous formulation has good strength, stiffness, porosity and distribution of filler in the Z-direction With further reference to the SEM images of FIGS. 6*a* and 6*b* (surface a and cross-section b), the sheets were produced with 81% PCC filler. The addition of an Acronal binder (resin) of Tg=3 deg. C. to the aqueous composition of 50/50 mixture of fibrillated long fibers of softwood kraft pulp/cellulose fibrils CNF/PCC filler, allowed a complete fixation of filler on the small fraction of fibrous surfaces. The aggregated PCC particles are well bonded by the matrix composed of cellulose and film forming binder.

Figure 7:
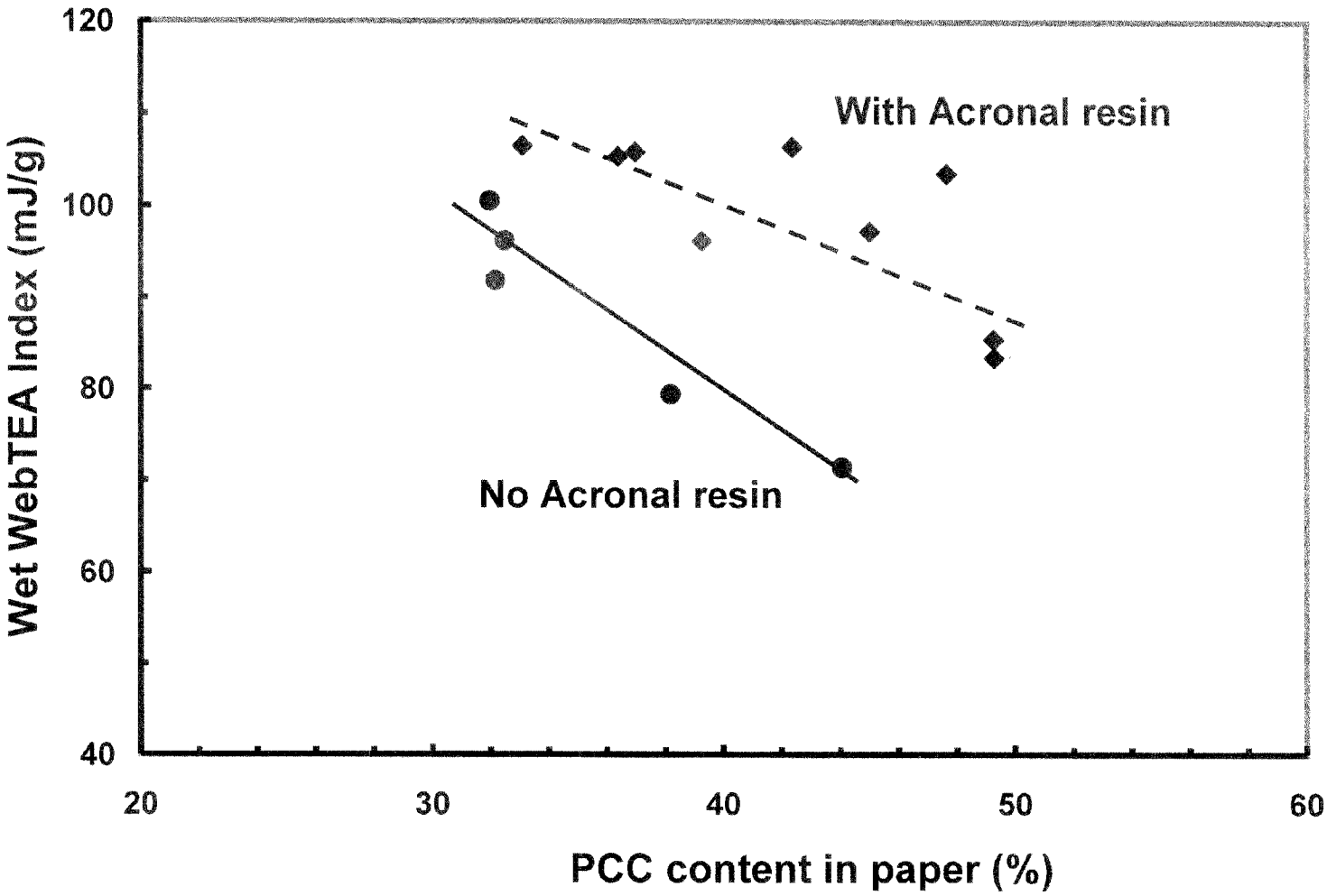
FIG. 7 illustrates graphically the wet web strength of super-filled never-dried sheets of the invention at a wet-solids content of 50%. These sheets were produced on the pilot paper machine at 800 m/min.

With further reference to FIG. 7, this shows the value of wet-web strength achieved without and with treatment technology of the invention. As mentioned earlier, wet-web strength is very critical for the runnability of paper machine producing super-filled sheets. To evaluate the effect of binder on the wet-web strength of super-filled sheets, a pilot paper machine trial was conducted using the following conditions. An aqueous composition made of fibrillated long fibers was composed of 70% well developed bleached softwood thermomechanical pulp (CSF=50 mL)/30% refined bleached softwood kraft pulp (CSF: 350 mL) was blended with 70% PCC then the mixture was treated with 0.5% Acronal (trademark) binder of $T_g$ 0° C. The mixing temperature of the furnish was 50 deg. C. To the binder treated composition was added the following co-additives: 0.12% polyvinylamine (PVAm) from BASF and 1.2% cationic starch, followed by a dual retention aid system (0.04% cationic polyacrylamide/0.03% anionic micropolymer). This furnish was successfully used to make paper of basis weight ranging between 75 and 90 g/m$^2$ and filler content up to 50% on twin wire pilot papermachine at speed of 800 m/min. For comparison, highly filled sheets were also produced in the absence of binder and co-additive. As shown in FIG. 7, the presence of the binder improved wet-web strength significantly. This improvement was more substantial at the higher filler content.

EXAMPLES

The method of this invention can best be described and understood by the following illustrative examples. In the examples, the results were obtained using both laboratory scale techniques and pilot papermachine trials.

Example 1

Figure 6A:
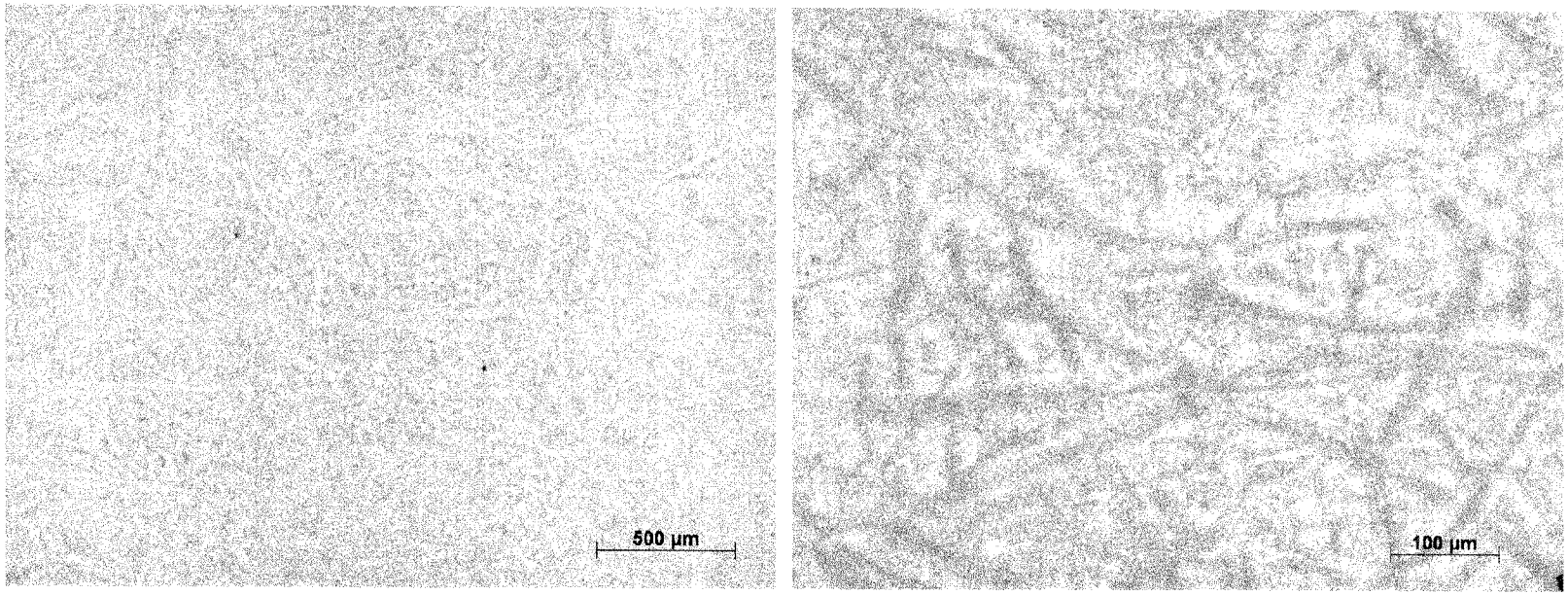
FIG. 6*a* shows SEM images at two magnifications levels, 500 μm and 100 μm of the surface of a highly filled sheet (81% PCC) made by this invention. The surface images of sheets indicate the distribution of fibrous component and filler component.
Figure 6B:
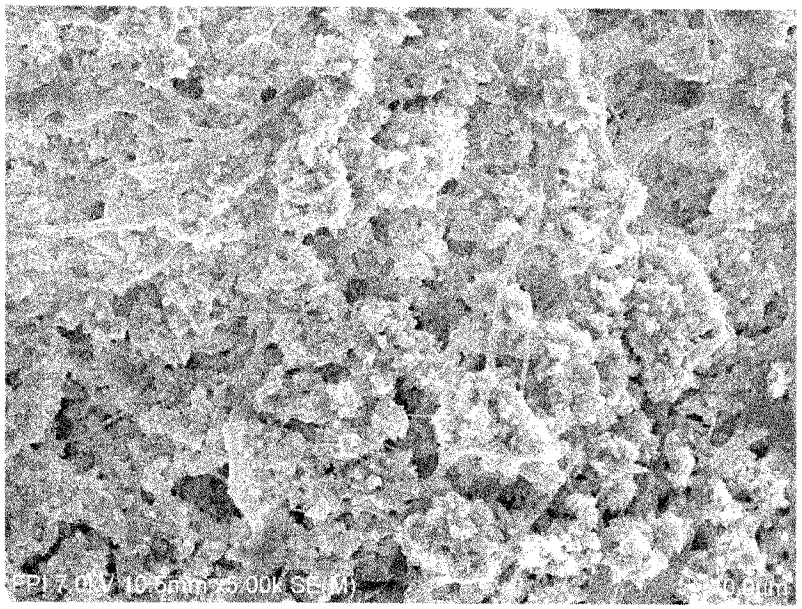
FIG. 6*b* shows SEM images at two magnifications levels of a cross-section of the highly filled sheet of FIG. 6*a*. The cross-section images show the PCC particles aggregated and fixed by Acronal binder on surfaces of a mixture of fibrillated long fibers of softwood kraft pulp and cellulose fibrils; of CNF.
Figure 6B:
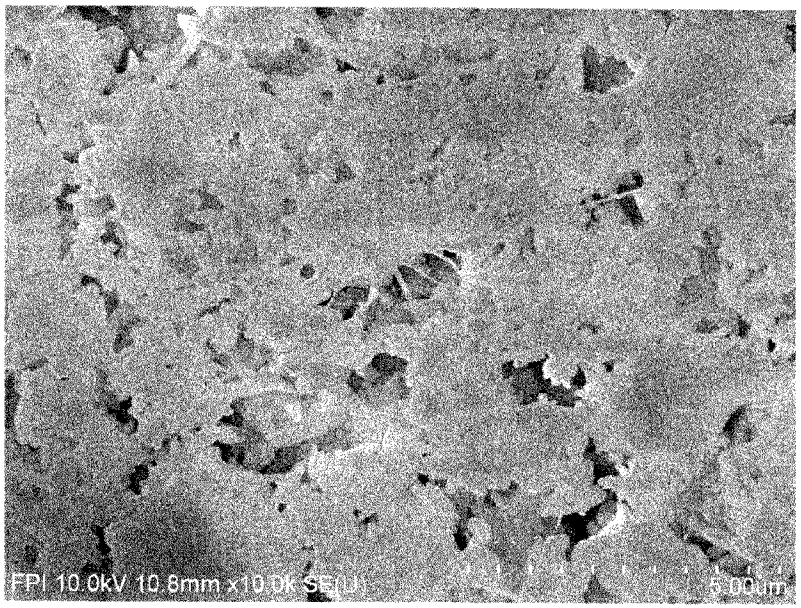

The paper samples of FIGS. 6*a* and 6*b* produced during the pilot papermachine trial were compared with a commercial fine paper (copy grade). The highly filled sheets had strength and stiffness similar to those of typical fine papers made from kraft pulp having only 20% filler. Table 1 show the testing results. All chemical % dosages are based on weight of dry materials.

TABLE 1

| Comparison of a commercial paper with trial papers | | | |
|---|---|---|---|
| Sample | Commercial fine paper 75 g/m$^2$ | Trial product 75 g/m$^2$ | Trial product 77 g/m$^2$ |
| Filler content in sheet, % | 20 | 40 | 50 |
| CD Gurley Stiffness, mgf | 67 | 70 | 76 |
| MD TEAindex, mJ/g | 457 | 489 | 409 |

Example 2

To further improve the wet-web strength of super filled sheets, cellulose fibrils CNF was be incorporated into the furnish composition. In one laboratory experiment, CNF was produced according to U.S. Ser. No. 61/333,509, Hua et al. The CNF was further processed to enable the surface adsorption of chitosan (a natural cationic linear polymer extracted from sea shells). The total adsorption of chitosan was close to 10% based on CNF mass. The surface of CNF treated in this way carried cationic charges and primary amino groups and had surface charge of 60 meq/kg. The surface-modified CNF was then mixed into a fine paper furnish at a dosage of 2.5%. The furnish contains 40% bleached kraft pulp (softwood: hardwood=25:75, refined to CSF 230 ml) and 60% of PCC. Handsheets containing 50% PCC were prepared with a dry weight basis of eight grams per square meter. For comparison, handsheets were also made with the same furnish but without CNF. In the absence of CNF, the resulting wet-web at 50% solids had a TEA index of only 23 mJ/g. In the presence 2.5% CNF, the TEA was improved to 75 mJ/g, more than 3 times that of the control.

Example 3

A 50/50 bleached softwood kraft pulp/CNF was blended with 80% PCC. The CNF was produced according to the description of the aforementioned U.S. Ser. No. 61/333,509 Hua et al. The bleached softwood kraft pulp was also blended with 80% PCC in the presence and absence of CNF. The bleached softwood kraft pulp was refined in a low consistency refiner (4%) to a CSF of 350 mL. The consistency of each furnish was 10%. Acronal resin of $T_g$=3° C. was added at a dosage of 1%, to each mixing furnish pre-heated to 50° C. Then co-additives were introduced to the treated furnish: 0.5% polyvinylamine (PVAm) followed by 3% cooked cationic starch. After 10 min mixing the retention aid system (0.02% CPAM and 0.06% anionic micropolymer) was introduced and retention was determined using a conventional dynamic drainage jar equipped with a 60/86 mesh papermaking fabric and furnish was sheared at 750 rpm. For comparison, retention was also determined without introduction of retention aid. In the absence of CNF, the PCC retention was only 50%. In the presence of CNF the PCC retention was over 95%, indicating that CNF has a very positive effect on retention of PCC.

Example 4

Commercial stone paper sheets (single layer and three layers) made by extrusion and calendaring process were tested for comparison with the super filled sheets of the invention. The results are shown in Tables 2a and 2b TABLE 2a

| Commercial stone paper | | | | | | | | | | | | | | |
|---|---|---|---|---|---|---|---|---|---|---|---|---|---|---|
| Sample # | BW, g/m$^2$ | Filler, % | Load N | Str., % | B.L., Km | Internal Bond, J/m$^2$ | PPS, mL/min | Caliper, mm | Density, g/cm$^3$ | Bulk, cm$^3$/g | Stiffness MD5o, mN/m | Scatt. Coeff., m$^2$/kg | Br., % | Op., % |
| #1 | 238 | 54 | 33 | 48 | 0.96 | Max | 10 | 0.26 | 0.896 | 1.115 | 0.86 | 38.7 | 90.9 | 96.9 |
| #2 | 311 | 78 | 29 | 33 | 0.64 | Max | 10 | 0.23 | 1.331 | .752 | 1.67 | 23.9 | 86.2 | 96.7 |

Average Light Absorption Coefficient of Above Sheets is 0.24 m$^2$/kg

TABLE 2b

| Commercial stone papers | | | | | | | | |
|---|---|---|---|---|---|---|---|---|
| Sample # | BW, g/m$^2$ | Filler, % | Load, N | B.L., km | Caliper, mm | Density, g/cm$^3$ | Bulk, cm$^3$/g | Stiffness MD5o, mN/m |
| #3 | 235 | 76 | 30 | 0.86 | 0.198 | 1.184 | 0.844 | 0.585 |
| #4 | 229 | 76 | 32 | 0.96 | 0.199 | 1.150 | 0.869 | 0.660 |
| #5 | 250 | 77 | 34 | 0.94 | 0.182 | 1.374 | 0.727 | 0.952 |
| #6 | 238 | 54 | 32 | 0.92 | 0.280 | 0.851 | 1.174 | 1.106 |

The paper sheets (150 g/m$^2$) of the invention were prepared, without and with introduction of CNF, using a dynamic sheet forming machine from aqueous compositions containing up to 80% PCC. To the compositions were added 1% Acronal binder. The CNF produced according to the invention of the aforementioned U.S. Ser. No. 61/333,509 Hua et al was modified with a polyvinylamine (PVAm) to make it positively charged. The temperature of the aqueous composition was 50° C. To the binder treated furnish the co-additive cationic starch at a dosage rate of 3% was added and mixing continued for 10 min, then retention aid was introduced. The dual retention aid (RA) system composed of cationic polyacrylamide and anionic micropolymer was used then sheets were produced. For all experiments the dosages of cationic polyacrylamide and anionic micropolymer were 0.02% and 0.06%. The formed moist webs were pressed on a laboratory roll press then dried on a photographic dryer at 105° C. Prior to testing the dried sheets were conditioned in a room at 50% RH and 23° C. for 24 hours.

For the experiments to make 150 g/m$^2$ highly-filled sheets the pulp fiber used was refined bleached softwood kraft pulp BSKP (CSF=350 mL), the filler slurry was PCC HO Scalenohydral structure supplied by Specialty Minerals Inc. The PCC slurry used throughout these examples has consistency of 20% and an average particle size of 1.4 μm.

The results of the highly filled sheets (single layer or three-layer) are shown in Table 2c and 2d.

TABLE 2c

Super filled sheets (single layer) of the present invention

| Sample # | BW, g/m2 | Filler, % | Load, N | Str., % | B.L., km | Internal Bond, J/m2 | PPS, mL/min | Caliper, mm | Density, g/cm3 | Bulk, cm3/g | Stiffness MD5o, mN/m | Scatt. Coeff., m2/kg | Br., % | Op., % |
|---|---|---|---|---|---|---|---|---|---|---|---|---|---|---|
| A | 147 | 72 | 30 | 2.69 | 1.38 | 65 | 329 | 0.24 | 0.621 | 1.61 | 0.35 | 171 | 93.9 | 98.9 |
| B | 139 | 74 | 52 | 3.84 | 2.54 | 183 | 218 | 0.23 | 0.606 | 1.65 | 0.46 | 188 | 94.1 | 99.0 |
| C | 147 | 81 | 57 | 4.44 | 2.64 | 183 | 199 | 0.23 | 0.636 | 1.57 | 0.84 | 172 | 93.7 | 99.1 |

Average Light Absorption Coefficient of Above Sheets is 0.17 m$^2$/kg

The order of ingredient addition to make the final furnishes and to produce the highly filled sheets is described below:

A: (75% PCC/25% rBSKP)+1% Acronal binder+0.5% PVAm+3% CS+RA;

B: (75% PCC/10% CNF/15% rBSKP)+1% Acronal binder+0.5% PVAm+3% CS+RA;

C: (75% PCC/15% CNF/15% rBSKP)+1% Acronal binder+0.5% PVAm+3% CS+RA.

Middle layer: (75% PCC/25% rBSKP)+1% Acronal binder+3% CS;

F: Top and bottom layers: (70% PCC/10% CNF/20% rBSKP)+1% Acronal binder+0.5% PVAm+3% CS;

Middle layer: (75% PCC/10% CNF/15% rBSKP)+1% Acronal binder+3% CS;

G: Top and bottom layers (85% PCC/15% CNF)+1% Acronal binder+0.5% PVAm+3% CS;

Middle layer: (75% PCC/10% CNF/15% rBSKP)+1% Acronal binder+3% CS.

All percentages % herein are by weight unless otherwise indicated.

The invention claimed is:

1. A furnish for papermaking comprising: fibrillated long fibres, inorganic filler particles, and a particulate anionic binder, in an aqueous vehicle, said inorganic filler particles being in an amount of 40% to 90%, by weight, based on total solids, said particulate anionic binder being in an amount of 0.5 to 100 kg/ton, by weight, based on total solids; and said inorganic filler particles being completely and irreversibly fixed on said fibres by said anionic binder such that said aqueous vehicle is free of unfixed inorganic filler particles and binder particles.

2. A furnish for papermaking according to claim 1, wherein said furnish further comprises cellulose fibrils.

3. A furnish for papermaking according to claim 2, wherein said cellulosic fibrils are cellulose nanofilaments (CNF) having a length of 200 μm to 2 mm and a width of 30 nm to 500 nm.

4. A furnish for papermaking according to claim 1, wherein said filler particles are in an amount of 60% to 80%, by weight, based on total solids.

5. A furnish for papermaking according to claim 4, wherein said furnish has a total consistency of up to 10%, by weight, solids.

TABLE 2d

Super filled sheets (three layers: Top/Middle/Bottom) of the present invention

| Sample # | BW, g/m2 | Filler, % | Load, N | Str., % | B.L., km | Internal Bond, J/m2 | PPS, mL/min | Caliper, mm | Density, g/cm3 | Bulk, cm3/g | Stiffness MD5o, mN/m | Scatt. Coeff., m2/kg | Br., % | Op., % |
|---|---|---|---|---|---|---|---|---|---|---|---|---|---|---|
| E | 154 | 71 | 34 | 2.83 | 1.50 | 75 | 306 | 0.24 | 0.635 | 1.574 | 0.451 | 167 | 94.0 | 98.9 |
| F | 151 | 72 | 60 | 4.84 | 2.69 | 180 | 196 | 0.23 | 0.649 | 1.540 | 0.645 | 180 | 93.7 | 99.1 |
| G | 153 | 76 | 52 | 5.02 | 2.33 | 213 | 179 | 0.24 | 0.642 | 1.557 | 0.752 | 185 | 93.6 | 99.1 |

Average Light Absorption Coefficient of Above Sheets is 0.17 m$^2$/kg

The order of ingredient addition to make the final furnishes and to produce the highly filled sheets is described below:

E: Top and bottom layers: (70% PCC/30% rBSKP)+1% Acronal binder+0.5% PVAm+3% CS;

6. A furnish for papermaking according to claim 1, wherein said fibrillated long fibres comprise softwood chemical fibers of CSF 50-400 mL or softwood thermo-mechanical fibers of CSF 30-60 mL.

7. A furnish for papermaking according to claim 1, further comprising co-additives.

8. A process of making paper comprising:

a) forming an aqueous papermaking furnish comprising fibrillated long fibres, inorganic filler particles and a particulate anionic binder, in an aqueous vehicle, said inorganic filler particles being in an amount of 40% to 90% by weight, based on total solids; and said particulate anionic binder being in an amount of 0.5 to 100 kg/ton, by weight, based on total solids;

b) mixing the furnish and subjecting the furnish to a temperature higher than the $T_g$ of the anionic binder to completely and irreversibly fix the inorganic filler particles with the anionic binder on the surfaces of the fibres, c) draining the furnish through a screen to form a sheet, and d) drying the sheet.

9. A process according to claim 8, wherein said furnish further comprises cellulose fibrils.

10. A process according to claim 8, wherein said cellulose fibrils are CNF having a length of 200 μm to 2 mm and a width of 30 nm to 500 nm.

11. A process according to claim 8, wherein said inorganic filler particles in a) are in an amount of 50% to 90%, by weight, based on total solids; said particulate anionic binder in a) is in an amount of 10 to 20 kg/ton, by weight, based on total solids; and said furnish in a) has a total consistency of up to 10%, by weight, solids.

12. A process according to claim 11, wherein said anionic binder is incorporated in said furnish in a) as a pre-heated aqueous dispersion having said temperature higher than the $T_g$ of the anionic binder.

13. A process according to claim 12, wherein said furnish in a) is mixed under shear with coating of the inorganic filler particles with the binder and aggregation of coated inorganic filler particles and deposit and binding of coated inorganic filler particles on the fibres.

14. A process according to claim 11, wherein said particulate anionic binder in a) is in an amount of 2 to 4 kg/ton, by weight, based on total solids.

15. A process according to claim 11, wherein said inorganic filler particles are completely and irreversibly fixed on said fibres by said anionic binder such that said aqueous vehicle is free of unfixed inorganic filler particles and binder particles.

16. A process according to claim 8, wherein said fibrillated long fibres comprise softwood chemical fibers of CSF 50-400 mL or softwood thermo-mechanical fibers of CSF 30-60 mL.

17. A paper comprising a matrix of fibrillated long fibres, inorganic filler particles and an anionic binder, said inorganic filler particles being in an amount of 40% to 90%, by weight, of the paper; said particulate anionic binder being in an amount of 0.5 to 100 kg/ton, by weight, of the paper; and said inorganic filler particles being completely and irreversibly fixed on surfaces of said fibres by said anionic binder.

18. A paper according to claim 17, in which said filler particles are bound with the binder to the surfaces of said fibres.

19. A paper according to claim 17, wherein said matrix further comprises CNF having a length of 200 μm to 2 mm and a width of 30 nm to 500 nm.

20. A paper according to claim 17, wherein said filler particles are in an amount of 60% to 80%, by weight; and said fibrillated long fibres comprise softwood chemical fibers of CSF 50-400 mL or softwood thermo-mechanical fibers of CSF 30-60 mL.

* * * * *